US011173508B2

(12) United States Patent
Knight et al.

(10) Patent No.: US 11,173,508 B2
(45) Date of Patent: Nov. 16, 2021

(54) PUMP DISPENSERS

(71) Applicant: RIEKE PACKAGING SYSTEMS LIMITED, Leicestershire (GB)

(72) Inventors: Simon Christopher Knight, Leicestershire (GB); Gaurang Mittal, Uttar Pradesh (IN)

(73) Assignee: RIEKE PACKAGING SYSTEMS LIMITED

( * ) Notice: Subject to any disclaimer, the term of this patent is extended or adjusted under 35 U.S.C. 154(b) by 0 days.

(21) Appl. No.: 16/764,449

(22) PCT Filed: Nov. 15, 2018

(86) PCT No.: PCT/EP2018/081352
§ 371 (c)(1),
(2) Date: May 15, 2020

(87) PCT Pub. No.: WO2019/096894
PCT Pub. Date: May 23, 2019

(65) Prior Publication Data

US 2020/0360949 A1 Nov. 19, 2020

(30) Foreign Application Priority Data

Nov. 15, 2017 (IN) ..... 201741040728

(51) Int. Cl.
*B05B 11/00* (2006.01)

(52) U.S. Cl.
CPC ..... *B05B 11/3047* (2013.01); *B05B 11/3074* (2013.01); *B05B 11/0044* (2018.08); *B05B 11/3001* (2013.01); *B05B 11/306* (2013.01)

(58) Field of Classification Search
CPC ..... B05B 7/005; B05B 7/0416; B05B 7/0025; B05B 11/0044; B05B 11/3001;
(Continued)

(56) References Cited

U.S. PATENT DOCUMENTS 3,237,571 A * 3/1966 Corsette ..... B05B 11/3066 417/513
4,079,865 A * 3/1978 Kutik ..... B05B 11/3015 222/259

(Continued)

FOREIGN PATENT DOCUMENTS

WO 9935079 A1 7/1999

OTHER PUBLICATIONS

International Search Report and Written Opinion dated Feb. 18, 2019; International Patent Application No. PCT/EP2018/081352 filed on Nov. 15, 2018. ISA/EP.

*Primary Examiner* — Vishal Pancholi
(74) *Attorney, Agent, or Firm* — McDonald Hopkins LLC

(57) ABSTRACT

A dispenser pump has a plunger operable in a body including an outer cylinder body having a vent opening in its sidewall and a body insert fitting into the top of the body cylinder and providing an external collar through which the plunger stem operates. The body insert has a lock-down thread to lock down the plunger for shipping. The insert also has an undulating annular vent-control bead extending right round its cylindrical outer surface, engaging the cylinder wall with interference for either blocking or unblocking the vent opening, according to whether the vent-control bead lies above or below the interior vent opening, by rotation between the body cylinder and body insert. The rotation can be driven by rotation of the plunger head, which makes a catch engagement with the top of the body insert. Blocking the vent during shipping reduces leakage.

15 Claims, 4 Drawing Sheets

(58) Field of Classification Search
CPC ..... B05B 11/3067; B05B 11/306; B05B 11/3087; B05B 11/3047; B05B 11/3074; G01F 11/028
USPC ..... 222/71, 321, 384, 481, 153.13, 309, 222/321.7, 481.5
See application file for complete search history.

(56) References Cited

U.S. PATENT DOCUMENTS

| | | | | |
|---|---|---|---|---|
| 4,340,158 | A * | 7/1982 | Ford | B05B 11/306 222/153.13 |
| 4,524,888 | A * | 6/1985 | Tada | B05B 11/0064 222/153.02 |
| 5,016,780 | A * | 5/1991 | Moretti | B05B 11/3001 222/153.13 |
| 5,405,057 | A * | 4/1995 | Moore | B05B 11/3023 222/153.13 |
| 5,524,793 | A * | 6/1996 | O'Neill | B05B 11/306 222/153.13 |
| 6,443,331 | B1 * | 9/2002 | DeJonge | B05B 11/00 222/153.13 |
| 8,827,121 | B2 * | 9/2014 | Law | B05B 11/306 222/321.9 |
| 2002/0056730 | A1 * | 5/2002 | van de Heijden | B05B 11/0005 222/190 |

* cited by examiner

PUMP DISPENSERS

CROSS-REFERENCE TO RELATED APPLICATION

This application is a 35 U.S.C. 371 national stage filing of PCT Application No. PCT/EP2018/081,352 filed on Nov. 15, 2018, entitled "PUMP DISPENSERS," which claims priority to IN Patent Application No.: 201741040728 filed on Nov. 15, 2017, each of which are incorporated herein in their entirety by reference.

FIELD OF THE INVENTION

This invention has to do with dispensers for liquid products, of the type in which a pump usually consisting essentially of moulded plastics components is mounted on the neck of a container of a liquid to be dispensed, and dispenses the liquid by an action in which a plunger of the pump is moved relative to a body of the pump. Such dispensers are widely used e.g. for dispensing soaps, cosmetics, toiletries, medical creams, lotions and the like. The invention particularly relates to the control of a pump vent and avoiding leakage via the vent.

BACKGROUND

Generally, pumps of the kind to which the present proposals relate have a pump body with an inlet to a pump chamber and an outlet passage from the pump chamber to an outlet opening. An inlet check valve assures directional flow, and usually an outlet valve is provided for adequate priming and re-fill of the pump chamber. The pump chamber is varied in volume by movement of the plunger, and usually is defined between a piston and cylinder; typically the piston is carried by the plunger and wipes the inside of a cylinder which is part of the pump body. The simplest, and hence most economical and popular, designs have the outlet passage through the plunger and that is the preferred type here. Preferably a pump spring biases the plunger to an extended position (up-position) relative to the body, at maximum pump chamber volume. The user depresses the plunger against this spring to reduce the pump chamber volume, close the inlet valve and drive product out through the outlet passage. In this description we describe pumps as with the plunger movement axis upright and the plunger at the top of the body (the position of full depression of the plunger then being the down-position), for ease of description and because it is preferred and normal, but the skilled person will understand that other orientations are possible. The terminology is relative and not absolute.

It is well-known to enable locking of the plunger axially relative to the body, especially for shipping purposes for which the locked-down position is more compact. Usually lock-down is by depressing and then turning the plunger, bringing interlock formations such as screw threads or lugs/slots into engagement. Other pumps provide for locking-up at full extension, preventing depression of the plunger. This may be e.g. for aesthetic reasons, or to avoid dispensing an unwanted dose by pushing the plunger down before locking. Some pumps provide for both up-locking and down-locking.

In general, pump dispensers nowadays are required to withstand more and more demanding shipping and transit conditions, including sending individually e.g. as mail packages. Shaking, inversion, impact and temperature changes can provoke leakage, either through small clearances and tolerances in the pump structure or by accidental detachment, damage or unlocking of the components.

A further requirement in pump dispensers of the kind described is the venting of outside air into the container interior, to compensate for the volume of product dispensed and to allow for flow during temperature or pressure changes, avoiding unsightly "paneling" (partial collapse) of the container. The sealed join between the pump body and the container—typically a seal between a flange on a cylinder body of the pump and the container neck—divides an exterior region from an interior region, and the vent must communicate between these while minimising leakage. Conventional vent paths enter between the movable plunger stem and the external surround or collar of the pump body or, where the latter is a discrete component, sometimes between this and the component defining the main pump body cylinder. A vent opening (usually a simple small hole) is formed through the cylinder wall to communicate with the container interior and complete the vent path. The vent hole in the cylinder wall is often aligned with the position of the pump piston so that, in the rest condition with the plunger up, the piston blocks the vent path to minimise accidental leakage. The vent opens when the pump is used.

However as mentioned many pumps provide for locking the plunger in a down or retracted position, blocking the main dispensing pathway and giving a compact format, but leaving the vent hole open to leakage of product into the cylinder above the piston during shipping. Such product can drain back out through the vent hole (often two opposed vent holes are provided to promote this) when the dispenser is put into use, but there is still an issue that, when the plunger head is initially unlocked and rises, some liquid which has leaked to above the piston is carried up or leaks through the body opening around the plunger stem, causing mess and annoyance.

In our Indian Patent Application 201741018391 filed 25 May 2017 we describe a pump in which the body insert thereof is movable relative to the outer body or body cylinder between positions in which a vent path, including a hole through a wall of the body cylinder, is respectively blocked and open. For this purpose, the body insert has a vent-blocking portion which engages the body cylinder in the locked condition to block the vent path, and is disengaged from the body cylinder in the unlocked condition to open the vent path, by bringing a recess or relative clearance into register with the vent opening of the body cylinder.

THE INVENTION

In these proposals we put forward new features of dispensers and dispenser pumps of the kind described, with a view to providing further advantageous options for preventing undesired leaking via a vent.

A first aspect of our proposals relates to dispenser pumps, and pump dispensers comprising such pumps mounted on containers, with measures for reducing or avoiding a tendency to leakage through the vent path. The pump has a plunger and a body, and the body comprises an outer or main body, generally including the cylinder of the pump, and a body insert portion through which the stem of the plunger extends.

The plunger has a head and a piston, and is rotatable relative to the body between axially locked and axially unlocked positions, in particular preferably having a locked-down position in which the plunger is held relatively retracted into the body (the other extreme being the extended or "up" position, which may also have a lock). The locking is by the inter-engagement of locking formations of the plunger—especially on the stem and/or on the underside of a head thereof—and of the body, typically formed on a body insert thereof and which may be either recessed inside the insert or exposed at its exterior. These locking formations are commonly in the form of threads or thread segments, or similar cam forms, or retaining flanges or slots to which access of corresponding projections on the other component is selective according to the rotational alignment thereof so that the plunger can be turned between locked and released positions. This is all in itself well-known. The movement to turn the plunger from the locked condition to the unlocked condition is called the unlocking rotation herein (while understanding that it may also entail an axial movement component, when inclined formations such as threads are used).

According to our proposal, the body insert, or at least a portion thereof, is rotatable relative to the body cylinder between positions in which a vent path, defined between the components and typically including a hole through a wall of the body cylinder, is respectively blocked and open. The body insert comprises a vent-control (vent-blocking or vent-isolating) formation which engages an inwardly-directed surface of the body cylinder and extends around the body insert making preferably a continuous seal around between the body insert and the body cylinder. The vent-control formation has portions which lie, in terms of their axial position, respectively above and below the axial position of the interior opening of the vent in the cylinder body wall. Away from the vent-control formation there is clearance for venting flow between the body insert and the cylinder wall. By turning the body insert to a position in which the corresponding portion of the vent-control formation lies above the interior vent opening, at least partly, the vent can communicate from the container interior down into the interior of the cylinder body (generally, above a piston therein) for operational venting. Conversely, by turning the insert relative to the cylinder to a position in which a portion of the vent-control formation lies lower than the interior vent opening, the vent-control formation by virtue of its lower position relative to the vent and engagement with the cylinder wall all around the cylinder, isolates the vent and from the entire space of the cylinder body. The vent-control formation may have the form of a radially-projecting rib or bead extending around the surface of the body insert. The body insert surface may be otherwise cylindrical in form, at least adjacent the vent-control formation. The vent-control formation may engage the interior surface of the cylinder body with interference, to assure adequate sealing. While the exact form of the vent-control formation in the circumferential direction (i.e. its locus around the insert body surface) is not critical, desirably it is curved or straight, without sharp (abrupt) angles and/or without acute angles. It may extend always with some circumferential component. It may follow an undulating or sinuous path around the insert body outer surface. It can have an upward extremity, loop or bight and a corresponding downward one for each vent. Commonly there is more than one vent, so a vent-control formation having periodic upward curved protrusions, with downward curved protrusions between, is suitable.

Preferably, in the rotationally pre-determined positions for the blocked and open positions of the vent, corresponding technically to a locked-down position and an operational position described elsewhere, the vent-control formation does not overlie the vent opening in the blocked position but rather lies below it, isolating it from the cylinder space below. In the operational (unblocked) position the vent-control formation may but lie above the vent opening or may overlie it while allowing communication down into the vent path.

Prior proposals using lands which contact over vent openings at selected circumferential positions may distort the circular symmetry of the insert and cylinder because, of necessity, they are pressed together only at local circumferential positions. In the present proposal, the vent-control formation may be formed to contact against the cylinder wall, such as with equal force/interference, evenly all around the structure, the shift between open and blocked conditions arising only from shifts in its axial location at specific circumferential positions. Since the forces are then evenly distributed around the structure, a more effective seal can be achieved.

The vent hole through (or past) the wall of the body cylinder is desirably at or adjacent the top of this wall, so as to be remote from the liquid in the container interior. This is typically a part of the body cylinder component adjacent where it fixes to the container neck, often a relatively rigid part. It may be desirable for the vent-control formation to engage a more flexible region of the cylinder wall, to limit the interference force and variation therein. These aims can be combined by providing that the interior opening of the vent in the body cylinder wall has a downward extension in the interior surface of the cylinder wall, e.g. in the form a channel, extending axially below the through-hole portion of the vent (i.e. below where it opens out into the container interior) so that the vent-control formation need not reach as high or above the actual vent through-hole in order to open the vent path.

The body insert is rotatable relative to the body cylinder between the vent-blocked and vent-open positions. Such rotation may be drivable by engagement between the plunger and the body cylinder or the body insert, preferably the body insert (since the body cylinder desirably remains fixed relative to the associated container neck, to define a reaction structure).

The body insert and body cylinder may comprise respective structures defining respective limit formations, such as stop abutments, which are engageable to limit or define a range of relative movement between the two components, especially relative rotation, and in particular so as to define one or more limit or stop positions corresponding to a relative orientation assuring the vent-blocked alignment and/or to a relative orientation assuring the vent-open alignment. Respective limit formations may define a predetermined available angle or sector of relative movement between insert and cylinder for operating the vent block/unblock function.

As mentioned, the plunger desirably engages the body insert to drive its movement for the vent blocking function, especially a rotational movement through a predetermined angle or sector, and/or movement between or up to one or more limit stop engagements. Formations of the plunger (usually on the stem and/or head thereof) desirably engage the body insert to turn it. The engagement may be selectively available at one or a few relative rotational alignments, e.g. corresponding to a fully locked condition (with reference to the mentioned preferred locking formations), such as a position at which the plunger is fully screwed down into or onto a lock-down thread of the body insert. Such catch engagements, acting to inhibit relative rotation between plunger and body, are useful to protect the pump against accidental unlocking, e.g. during shipping: see our WO2016/009,187 for a range of proposals which may be used herein, and the contents of which are incorporated herein by reference.

In preferred embodiments, a flexible rib, fin, lug or other projection on one component—preferably at or on the underside of the plunger head—is engageable by riding over a ramp to a position behind a shoulder abutment of the other component (such as on an outwardly- or upwardly-directed surface of the body insert, e.g. on an external collar portion thereof) so that it "clicks" into place when sufficiently tightened (by the rib deforming as it rides up the ramp). It can then strongly resist initial turning in the opposite direction because of the steeper abutment. To unlock, rotation force on the plunger must reach a threshold level to escape past the abutment and overcome the catch engagement.

Desirably in the invention the relative movement, e.g. rotation, between the body insert and body cylinder for operating the vent function initiates at a turning force—to overcome the friction between them—less than this threshold level, so that turning of the plunger drives the relative movement of the vent-control formation to block or unblock the vent. Limit or stop engagements between the body insert and body cylinder can then prevent further movement so that the threshold force can be exceeded, the catch disengaged and if desired the plunger then continues to turn relative to the body insert (e.g. for unlocking or locking). The locking formations are usually comprised in the body insert component.

Alternatively stated, in the preferred embodiments including a lock/unlock function for the plunger, there is lost rotational motion between the plunger and the body (especially, the body insert), such as a mentioned sector of actuation for the vent control movement being substantially less in angle than a sector of actuation for the plunger locking/unlocking relative to the body cylinder. The former may be e.g. less than 60% or less than 50% of the latter. The relative rotation of head/body cylinder for locking/unlocking may be e.g. from 100 or from 180 to 360 degrees, whereas that between the body insert and the body for vent blocking/unblocking may be less and e.g. from 30 to 100 degrees. The skilled person will appreciate that these angles are just illustrative, not fundamental, and can be adjusted according to the vent formations used and the body geometry. In addition to stops to limit the movement, a retainer engagement structure may be provided to hold the cylinder and insert components in the vent-open relative position after the plunger is released to rise. This retaining may be releasable, able to be overcome by a threshold turning force in the opposite sense e.g. the locking direction.

It is preferred that the mechanism is reversible, so that rotation of the plunger in the locking sense can also move the body insert relative to the body cylinder from the vent-open to the vent-blocked condition, as well as the unlocking rotation moving them from the vent-blocked to the vent-open condition as already described. In practice, this may correspond to a user being able to fully close down the dispenser after it has previously been opened and used. It is within the scope of these proposals that only one of these functions is provided; desirably at least the unlocking movement that unblocks the vent is provided. Such a single functionality might be by the plunger head engaging the body insert only in one rotational sense, or by appropriate limit abutments between the body insert and body cylinder being provided only for one direction of relative rotation.

Alternatively rotation might be by direct turning of the insert component by the user, manually engaging an external portion thereof, e.g. a collar thereof, rather than by turning the plunger head.

Preferably more than one vent is provided, e.g. two vents at diametrically opposed positions.

In a preferred embodiment the body cylinder comprises a cylinder portion, a locating flange which engages the container neck in use (and desirably incorporates formations for making an interlock with the neck to prevent rotation), and an upstanding tubular top retaining formation, which may project up through the opening of a securing ring or securing cap used to hold the body flange down onto the container neck, and onto/into which the body insert is secured, but so as to be relatively rotatable e.g. by snap ribs or the like. The body insert may then include an insert portion extending down below the body flange and overlapping a region having the one or more vent openings of the body. Additionally, the body and body insert comprise respective stop formations defining a restricted range of relative rotation between the components. Projections formed on the inside of the upstanding top portion of the body cylinder and on the outside of the insert portion of the body insert are suitable. These formations may be repeated around the structure, two or more times.

General Dispenser Features

The primary features of pump dispensers of the kind which the invention relates have already been described above.

Typically the pump or pump module is a discrete module connected to a container neck, with all or part of the pump body projecting down inside the container interior. The pump module may comprise a closure portion which engages around the neck to close it so that liquid outflow is through the pump, and engages it to hold the pump module and container together. The body normally also comprises a cylinder portion, with a cylinder wall and inlet formation to provide a pump chamber in cooperation with a piston of the plunger. A cylinder portion and closure portion may be formed in one piece, as a cylinder/closure component ("cylinder body" for short). Usually a discrete outer securing cap is provided, adapted to fix down onto the container neck e.g. by a thread or snap engagement, to hold the body in place, having an opening through which the plunger projects, and optionally a top portion of the pump body too such as of a cylinder or collar described herein.

The pump body may have internal features inside the cylinder portion to provide various features, and these can be on the insert.

The pump body may have a collar portion around where the plunger emerges from an opening of the body, providing one or more functions such as sealing, locking and the like between the body and plunger at the exterior. This collar will usually overlap the interior void of the cylinder portion so that again, because of moulding constraints, it is often made as a discrete component fixed to the cylinder portion or closure portion. In preferred embodiments herein the insert portion and collar portion are combined in a single collar/insert component ("body insert" for short, as referred to above) part of which (insert tube) extends down inside the cylinder portion and part of which (collar) is above at the pump exterior.

The body insert may for example have formations providing any one or more of uplocking and/or downlocking in relation to a stem of a plunger, a seat for a pump spring, and one or more seals to engage the plunger as discussed later.

Usually it is fixed axially into the body cylinder portion or closure portion e.g. by a snap fit.

The inlet valve may be of any kind, but typically is a ball valve. The inlet may have a dip tube fitting e.g. socket, holding a dip tube which extends down into the container interior.

Typically the plunger is of the kind incorporating the outlet passage and outlet opening, i.e. a "moveable nozzle" pump. Usually the plunger has a head on which the user presses and where the outlet opening is provided (e.g. at the end of a laterally-projecting nozzle), a stem projecting axially down from the head into the pump body through an opening thereof, and a piston on the stem engaging the wall of the cylinder portion with a pump seal. The lower end of the stem has an entry to the outlet passage below the piston seal, i.e. in the pump chamber, which opens in the down-stroke of the plunger. An outlet valve function may be provided by a moveable valve body, e.g. a conventional ball valve in the outlet passage of the plunger. More preferably it is provided by slidable mounting of pump seal/piston on the stem, in which a sleeve mounting of the piston covers or uncovers one or more entry windows to the outlet passage according to the relative position of the piston, which moves up relative to the stem on the downstroke and vice versa.

The cylinder portion of the pump body may have a said vent opening for admitting compensation air into the container, positioned above the pump seal in the down-position.

Preferably most or all of the pump components are made from polypropylene (PP). A flexing seal element, such as a piston pump seal, may be of softer material such as LDPE. The container material is not critical but may be e.g. HDPE.

The volume dispensed per stroke may be any conventional amount, but typically is between 0.5 and 20 ml, more usually between 1 and 10 ml or between 1 and 5 ml.

It will be understood that while the present specification uses orientational terms such as top, bottom, upper, lower, above, below etc. in describing the invention, these are relative and not absolute. They are not intended to limit the invention to pumps resting in or used in that specific orientation, although it is the usual and preferred orientation hence the use of these terms for ease of comprehension. Thus upper and lower can be regarded in general terms as meaning inner and outer, up and down (plunger) as extended and retracted, "above" as axially relatively towards the plunger head, "below" as axially relatively away from the plunger head, and so forth.

BRIEF DESCRIPTION OF THE DRAWINGS

Embodiments of our proposals are now described by way of example, with reference to the accompanying drawings in which.

DETAILED DESCRIPTION

Figure 1:
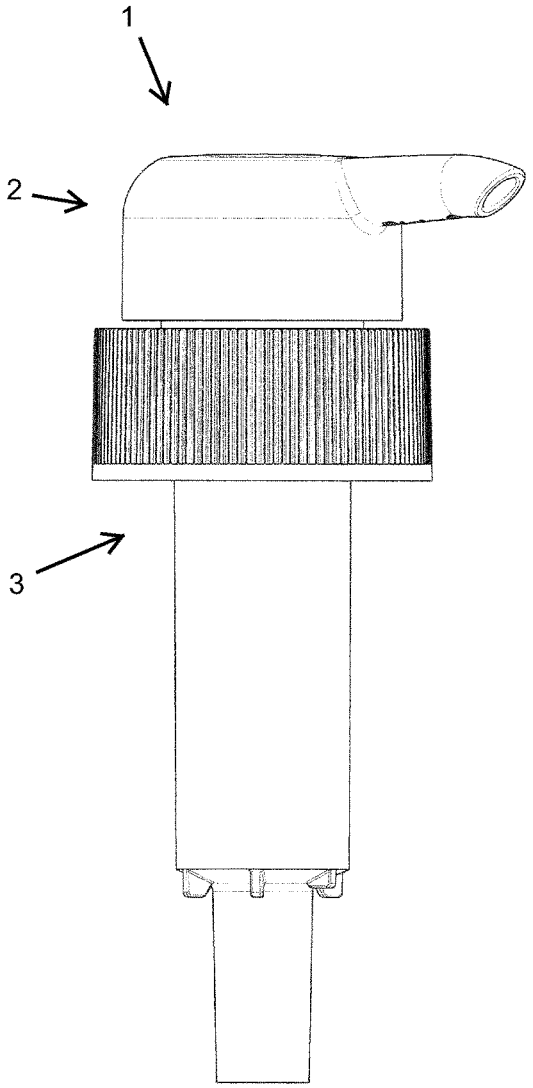
FIG. 1 and FIG. 2 are side views of a dispenser pump embodying the invention, respectively in the locked-down and plunger-up positions.
Figure 2:
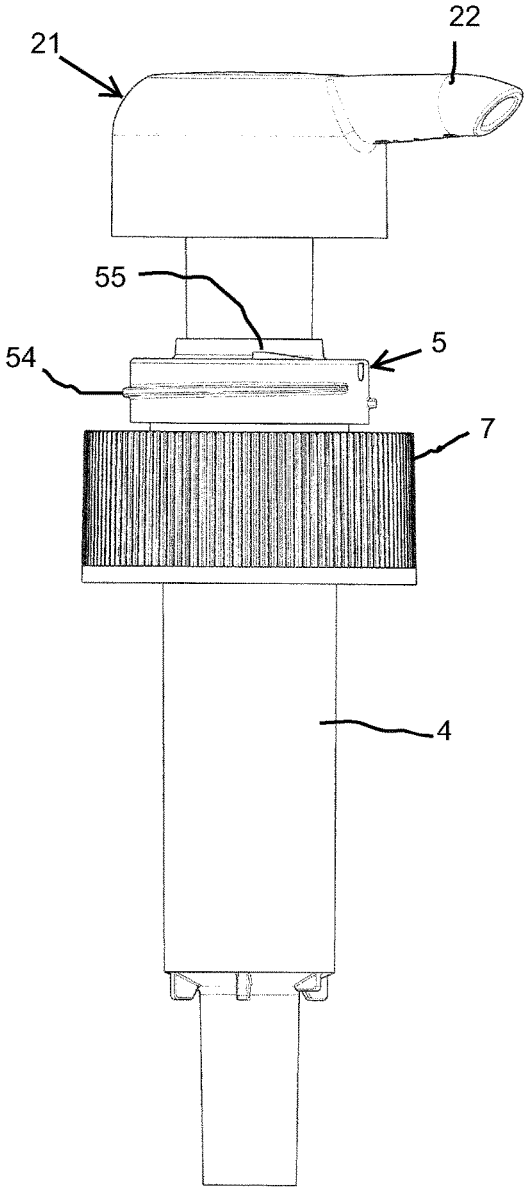
Figure 6:
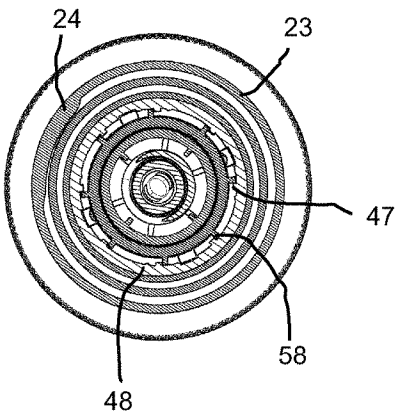
FIG. 6 is a corresponding cross-section of FIG. 4 (locked-down position)
Figure 4:
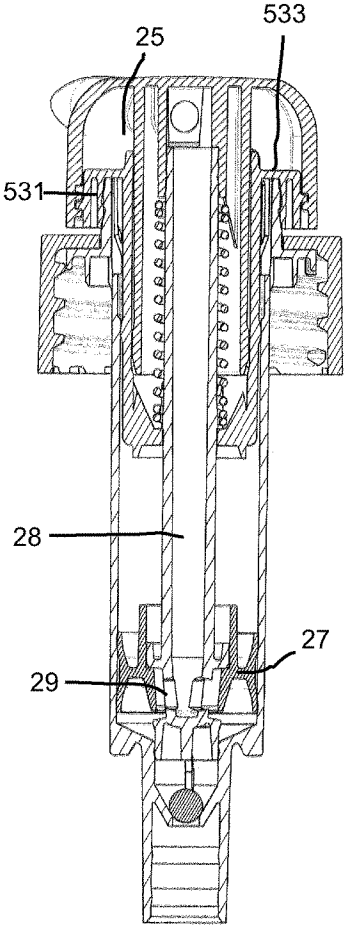
FIG. 3 and FIG. 4 are axial cross-sectional views of the pump in the plunger-up and locked-down positions.
Figure 3:
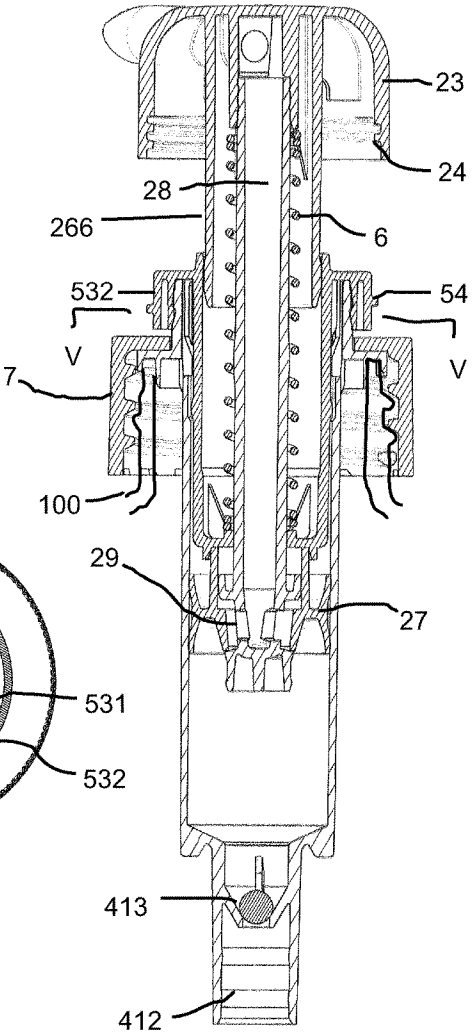

With reference to the figures, a dispenser pump 1 has a pump body 3 and a plunger 2 reciprocable in the body cylinder 4 of the body 3. The body 3 also comprises a body insert 5 fitted into the top of the body cylinder 4. A threaded retaining cap 7 fixes the body into the neck of the container 100 (shown fragmentarily and schematically in FIG. 3). The pump body projects down into the container interior.

Considering these components in more detail, the body cylinder component 4 includes a cylinder 41 with a cylinder wall 42, and defining an inlet 412 at its lower end (for example, to take a dip tube) and having a valve 413. Near its top the body cylinder component 4 has a projecting support flange 43 with an array of downward interlock formations in the form of projections 44 which engage corresponding projections on the neck of the container (not shown) as described in our above-mentioned Indian application and in our earlier PCT/EP2017/061611, to hold the body securely against rotation, and particularly anticlockwise rotation, relative to the container neck for reasons discussed below.

Figure 7:
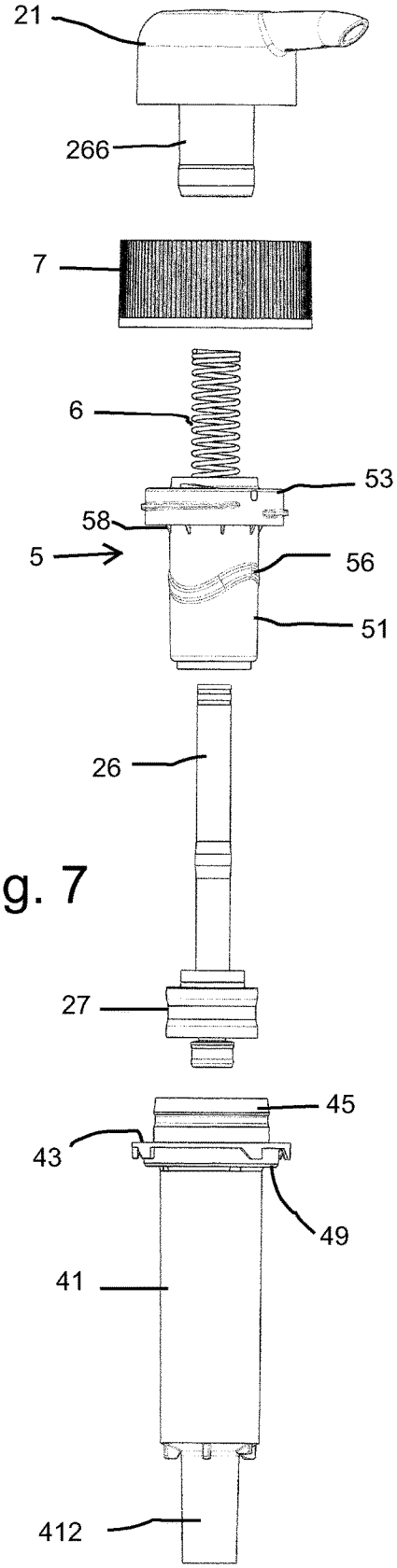
FIG. 7 is an exploded view showing all the main components of the pump.
Figure 9:
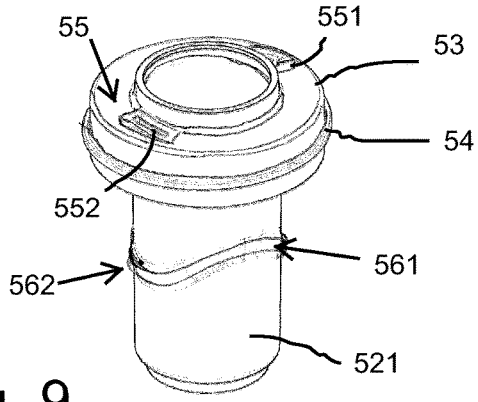
FIG. 9 is an oblique view of the body insert component.

The body insert 5, seen particularly in FIGS. 7 and 9, comprises a lower insert tube 51 having a tube wall 52 with an outer cylindrical surface 521. At the top of the body insert is a radially enlarged top collar 53, which snaps down over an upwardly-projecting fixing skirt 45 of the body cylinder 4 having corresponding snap formations 451, to hold the assembly together axially while allowing relative rotation. The collar and flange trap between them the top inward flange 71 of the retaining cap 7, which also has an outer securing skirt 72 with inward threads 73 to fix on the neck of the container 100. The underside of the support flange 43 of the body cylinder 4 has an annular plug sealing skirt 49 which fits with interference into the container neck to make a seal without a separate seal ring being required.

The top collar 53 of the body insert 5 has an inner skirt 531 making the snap engagement with the body cylinder skirt 45 and an outer skirt 532 carrying an external thread 54 which constitutes a lock-down formation for the plunger, discussed below.

Immediately beneath the support flange 43 the cylinder 41 has a pair of diametrically-opposed vent holes 46 communicating through the cylinder wall 42 between the container interior and the interior of the cylinder 41. A slight radial clearance 88 is defined between the cylinder 41 and the body insert tube 51. See FIG. 10: at the inner surface of the cylinder the vent through-hole 46 communicates into a downward extension channel 461 recessed into the cylindrical surface of the cylinder wall and providing an interior opening extending substantially below the through-hole of the vent 46.

Around the inside of the top fixing skirt 45 of the body cylinder 4 is a set of spaced rotational stops 47 in a form of vertical bars, and these can engage with corresponding insert stop ribs 58 around the underside of the collar 53 of the body insert 5: see FIG. 7.

The plunger 2 comprises a head 21 with a nozzle 22, projecting as an actuator for manual pressing at the top of the dispenser, and an axial stem 26 defining an internal outlet passage 28 and carrying a piston 27 that works in the cylinder 41. In this embodiment the piston 27 is formed as a sliding valve member over stem entrance openings 29 for the outlet passage 28, so that piston friction against the wall operates an outlet valve function. The piston also closes the outlet passage when the pump is locked down.

Figure 8:
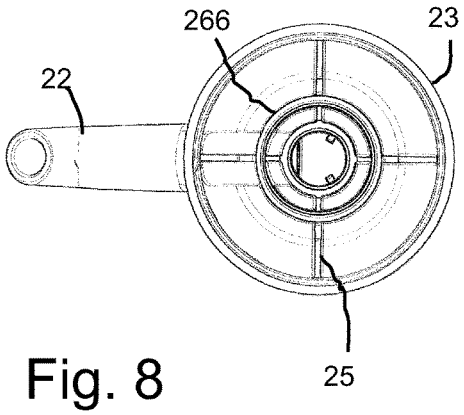
FIG. 8 shows the underside of the detached plunger head.

The plunger head has a conventional outer shell or shroud 23, and a set of stiff radial ribs 25 beneath the shroud (see FIG. 8). The internal edge of the shroud has a female lock-down thread 24 to engage with the corresponding male thread 54 on the body insert collar 53.

Figure 5:
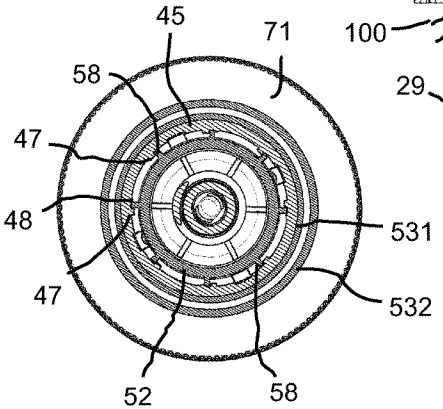
FIG. 5 is a radial cross-section of FIG. 3 (plunger-up position) at V-V.

The body insert 5 and plunger head 21 also have structures to make a security catch engagement supplementing the lock-down function. To reduce the possibility that the lock-down thread engagement might work free, e.g. during shipping or transit of the product which might entail substantial vibration, a catch mechanism is provided to resist turning away from the fully locked-down position. It includes a pair of catch teeth 55 on the top flange 533 of the collar 53, each tooth 55 having a perpendicular abutment face 551 and a gently sloping ramp face 552 facing in opposite directions. For lock-down the plunger is pushed down and then turned clockwise to engage the screw threads 24,54. As the thread engagement approaches completion, a pair of the radial ribs 25 beneath the plunger head come into engagement with the ramp faces 552 of the respective catch teeth 55 on the collar, and ride over then with interference until they click down behind the abutment faces 551. In conjunction with the friction of the thread engagement, this imposes a substantial threshold force which must be overcome to unlock the plunger by anticlockwise rotation. This is why the pump body cylinder 4 engages the container neck by the interlock formations 44; to prevent it from turning so that the downlock can reliably be released by applying the threshold turning force, without undesirably turning the cylinder 4 in the container neck. The turning force of the plunger head on unlocking is applied to the body insert 5 initially primarily through the catch teeth 55, until they are overridden and release. The thickness, resilience and interference of these structures are adjusted so that the release torque or threshold force for the catch engagement is greater than the force required to turn the body insert 5 relative to the body cylinder by frictional sliding. Accordingly it is the insert that turns first, and this rotation continues, e.g. for about 40°, until the stop ribs 58 of the body insert 5 meet the corresponding stop ribs of the body cylinder 4 and relative rotation must cease, whereupon the applied force rises to the catch threshold, overcomes the engagement of ribs 25 and catch teeth 55 and the plunger starts to unscrew from the locked-down position on the body insert 5. The body insert then holds its rotational orientation relative to the cylinder 4. Secondary retainer projections 48 (see FIGS. 10 and 5) define retaining grooves next to some of the stop ribs 47, so that routine or casual clockwise turning of the plunger, e.g. when in the up position, does not cause accidental shifting of the insert 5 clockwise relative to the cylinder 4.

The significance of the controlled relative rotation between the body insert 5 and body cylinder 4 is in controlling the operation of the vents 46. As mentioned, the purpose of these is to allow equalisation of pressure in the container 100 after dispensing of liquid, by allowing air entering the pump—through the top opening of the collar, around the fitting skirt 226 of the plunger head—down through the insert 5 and the opening through its base (defined through a lower spring support flange 64) and up around the insert 5 through the clearance 88. For shipping, the plunger is locked down as seen in FIGS. 1, 4, 6 and 11. In this position the vents 46 cannot be blocked by the plunger piston as they are in some dispensers. In any case, the vents in this construction are at the top of the cylinder body where the piston could not reach them. Accordingly, there is a risk that liquid from the container interior can enter the narrow clearance 88 through the vent holes 46 and get down into the cylinder space above the piston with the risk of then leaking to the exterior around the stem when the plunger is unlocked and raised.

To prevent this, a vent-control formation is provided on the body insert and can best be seen in FIGS. 7 and 9. It takes the form of a projecting bead or rib 56, extending right around the otherwise cylindrical outer surface 521 of the insert tube 51, and being smoothly curved in a sinuous undulating form having two relatively high or upper regions 561 and two relatively low or lower regions 562. The bead 56 is moulded integrally with the wall of the body insert 5, and dimensioned so as to fit with slight interference into the cylinder 41, causing slight flexion of the cylinder wall 42 and making an effective seal. Because the bead 56 has the same radial projection extent all around the pump, the circular form is not distorted so the seal is less prone to leakage and sticking than circumferentially-localised blocking lands.

Figure 10:
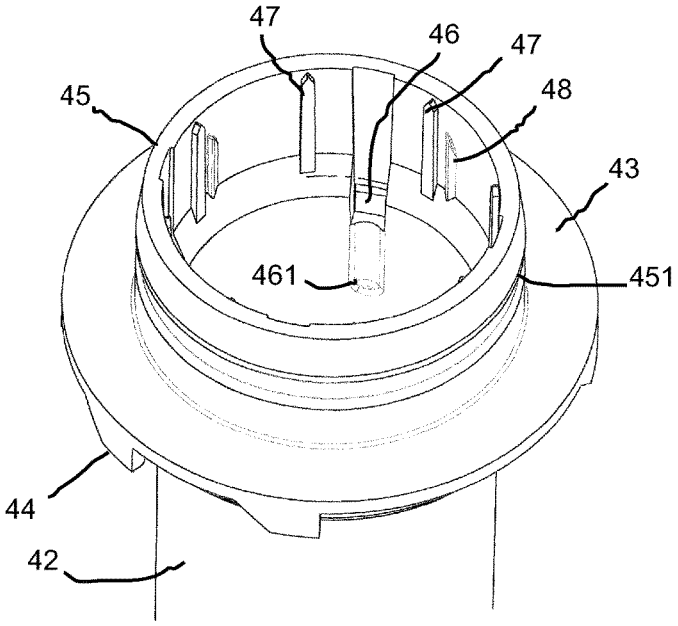
FIG. 10 is an enlarged view of the top end of the body cylinder component.
Figure 12:
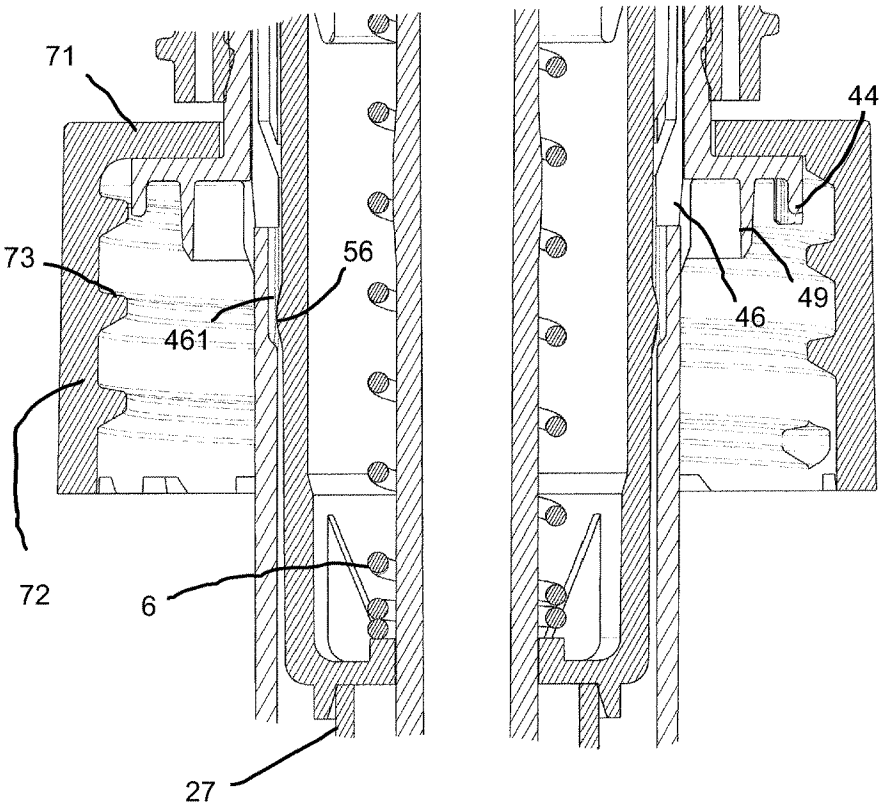
FIG. 12 is a corresponding view with the plunger up as in FIGS. 2 and 3.
Figure 11:
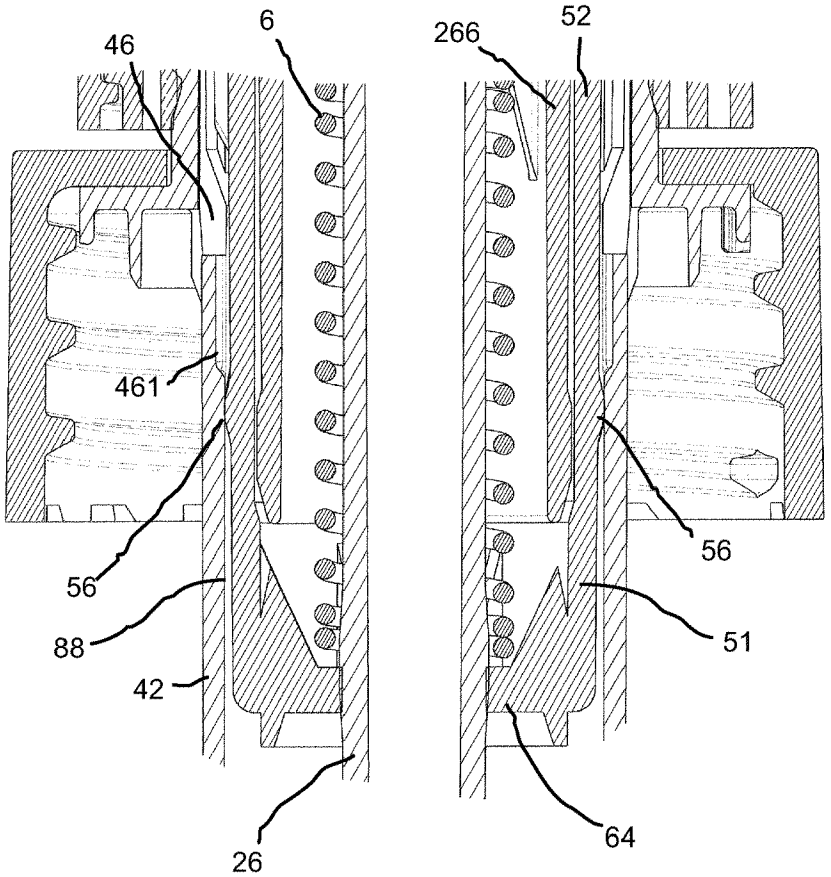
FIG. 11 is an enlarged axial cross-section showing the positions of structures near the pump vents with the plunger locked down, as in FIGS. 1 and 4.

The interaction of the vent-control bead 56 with the two vents 46 can be understood from FIGS. 9 and 10, and seen directly in FIGS. 11 and 12. In the locked-down position of FIG. 11, the body insert 5 is at its clockwise extreme relative to the cylinder 4 and the low regions 562 of the bead 56 are circumferentially aligned with the interior openings of the respective vents 46. These low regions 562 are below the level of the interior openings of the vents, even considering the downward opening extension channels 461 thereof. Accordingly, in this position as clearly seen in FIG. 11, the vent-control bead 56 completely blocks any communication from the container interior to the interior of the cylinder 41 through the vents 46. This because it extends below the vent openings and seals right around between the insert and cylinder. The skilled person can devise other specific paths for one or more vent-control formations such as elongate beads or ribs in line with these proposals. The problem of escaping liquid during transit is thereby avoided.

The position after release of the lock-down, with the body insert turned to its anticlockwise extreme relative to the cylinder 4, is seen in FIG. 12. In this orientation, part of a high region 561 of the vent-control bead 56 is brought into circumferential register with each of the vents 46. By virtue of the downward extension channels 461 the level of the upper bead portion 56 lies above at least a portion of the vent interior opening so that venting communication is established between the container interior and the clearance 88 between the cylinder 4 and insert 5, leading down into the cylinder interior. The vents 46 accordingly become functional for dispensing.

The high position of the actual through-holes of the vent 46, leading from the container interior, minimises liquid access to the vents. However, this position is part of the thicker-section material adjacent to support flange 43. Interference of the vent-control bead of the insert 5 at this position might involve excessive force and low dimensional tolerance. Extending the effective interior opening position downwards by means of the channel recesses 461, the bead 56 can lie at a level corresponding to a lower, more flexible part of the cylinder wall 42.

While the continuous rib or bead type formation is a preferred embodiment herein, the skilled person will appreciate that the combination of features providing controlled rotation of the body insert driven from the plunger as disclosed herein, especially in a down-locking pump and more especially one with a catch for the rotational down-lock, can be used with alternative vent-control (vent-blocking or vent-isolating) formations acting between the insert and cylinder body. These might be e.g. blocking lands, or rib-form formations which surround the vent without extending all around the insert. Such constructions are also contemplated as an aspect of our proposals herein.

The invention claimed is:

1. A dispenser pump comprising a plunger and a body, wherein the body includes a body cylinder and a body insert received within a top portion of the body cylinder;

wherein the plunger includes a head, a stem and a piston and wherein the plunger is rotatable relative to the body and axially movable between a locked-down position in which the plunger is held relatively retracted into the body and an unlocked position extended away from the body;

wherein a vent path is defined by a radial clearance between the body insert and body cylinder, said vent path communicating with a vent opening formed in the cylinder, and wherein the body insert includes a projecting, at least partially circumferential vent-control formation which engages a wall of the cylinder, said vent-control formation having high and low portions lying respectively axially above and axially below the vent opening and wherein the body insert is rotatable relative to the body cylinder so as to align the high portion of the vent-control formation circumferentially with the vent opening when the vent path is open or so as to align the low portion of the vent-control formation below the vent opening when the vent path is closed.

2. A dispenser pump of claim 1 in which the vent-control formation is an annular rib or bead projecting radially from a generally cylindrical outer surface of the body insert.

3. A dispenser pump of claim 1 in which the vent-control formation defines sinuous or undulating circumferential line around the body insert.

4. A dispenser pump according to claim 1 in which the vent-control formation engages the body cylinder with radial interference.

5. A dispenser pump according to claim 1 in which the vent opening comprises a through-opening through the wall of the body cylinder communicating with a recess on an interior surface of the wall, said recess extending axially below the through-opening.

6. A dispenser pump according to claim 1 in which a threaded engagement between the plunger and the body maintains the locked-down position.

7. A dispenser pump according to claim 5 in which the body insert rotates in concert with the plunger based upon engagement of the plunger and the body insert.

8. A dispenser pump according to claim 6 in which engagement of the plunger and the body insert is at a relative rotational alignment corresponding to a fully locked-down position, and further comprising a catch mechanism on one or both of the plunger and the body to resist relative movement away from the relative rotational alignment.

9. A dispenser pump according to claim 6 in which engagement of the plunger and the body insert is provided by a flexible rib, fin, lug or projection at or on the underside of the head and an upwardly-directed surface of the body insert having a shoulder abutment and a ramp leading to the shoulder abutment so that the flexible rib, lug, or projection slides over the ramp upon rotation and is retained behind the shoulder abutment.

10. A dispenser pump according to claim 1 in which the body insert and body cylinder each include cooperating limit formations or stop abutments to limit a range of relative rotational movement between the body insert and the body cylinder.

11. A dispenser pump according to claim 6 wherein rotation of the plunger initially drives relative rotation of the body insert and body cylinder to block or unblock the vent path, until the body insert and body cylinder make a rotational stop engagement therebetween so that further relative rotation of the plunger and body insert drives the threaded engagement thereof.

12. A dispenser pump according to claim 1 in which the body cylinder comprises a cylinder portion with a wall having the vent opening, an annular locating flange to engage a container neck in use, and a top retaining formation, the body insert being secured relatively rotatably to the top retaining formation.

13. A dispenser comprising a container for liquid product and having a neck, and a dispenser pump according to claim 12 connected to the container neck.

14. A dispenser according to claim 13 in which the body cylinder of the pump comprises a locating flange to engage the container neck, the locating flange comprising a set of downward interlock projections which make an interlock engagement with the container neck to prevent rotation of the body cylinder relative to the container neck.

15. A dispenser pump according to claim 1 in which a continuous seal is formed between the body insert and the body cylinder, the continuous seal including the vent-control formation.

* * * * *